United States Patent [19]

McCutchen

[11] 4,441,643

[45] Apr. 10, 1984

[54] PALLET-FORMING APPARATUS

[75] Inventor: Norman L. McCutchen, Lake Mills, Iowa

[73] Assignee: Cummins Engine Company, Inc., Columbus, Ind.

[21] Appl. No.: 343,821

[22] Filed: Jan. 29, 1982

[51] Int. Cl.[3] ..... B27F 7/09

[52] U.S. Cl. ..... 227/110; 227/152

[58] Field of Search ..... 227/4, 100, 101, 102, 227/103, 104, 105, 110, 111, 152, 151

[56] References Cited

U.S. PATENT DOCUMENTS

| | | | |
|---|---|---|---|
| 1,392,222 | 9/1921 | Rasmussen | 227/152 X |
| 2,994,881 | 8/1961 | Kaufman | 227/151 X |
| 3,207,403 | 9/1965 | Stoddard et al. | 227/101 |
| 3,273,776 | 9/1966 | Bryson | 227/109 |
| 3,514,028 | 5/1970 | Kowalczyk | 227/151 X |
| 3,591,067 | 7/1971 | Vial | 227/4 |
| 3,763,547 | 10/1973 | Blakeslee | 227/101 X |
| 3,822,817 | 7/1974 | Umphress | 227/110 |
| 3,876,128 | 4/1975 | Feren | 227/7 |
| 3,968,560 | 7/1976 | Vial | 227/152 X |
| 4,039,111 | 8/1977 | Rogers | 227/30 |
| 4,054,236 | 10/1977 | Paxton | 227/45 |
| 4,204,624 | 5/1980 | Gunn et al. | 227/45 |
| 4,305,538 | 12/1981 | Schultz | 227/132 X |
| 4,330,921 | 5/1982 | White, Jr. | 227/152 X |

*Primary Examiner*—Paul A. Bell

*Attorney, Agent, or Firm*—Neuman, Williams, Anderson & Olson

[57] ABSTRACT

An apparatus is provided for forming a pallet having a plurality of runners arranged in spaced parallel relation and subtending a plurality of deck boards arranged in spaced parallel relation. The apparatus includes a surface on which the runners are supported, and power actuated fastener-driving means mounted in overlying relation with respect to a predetermined area of the surface and vertically adjustable relative thereto between operative and inoperative modes. Adjustably mounted on the surface area is a stop means which is adapted, when in one position of adjustment, to be engaged by a runner when the latter is in vertical alignment with the fastener-driving means. An adjustable runner-retention means is provided which, when in one position of adjustment, coacts with the stop means and retains a runner against the stop means while the fastener-driving means is in the operative mode and is fastening corresponding segments of the overlying deck boards to the runner.

6 Claims, 9 Drawing Figures

PALLET-FORMING APPARATUS

BACKGROUND OF THE INVENTION

Various pallet-forming apparatus have heretofore been provided; however, because of inherent design characteristics they are beset with one or more of the following shortcomings: (a) they are of complex, costly construction and require an inordinate amount of service and maintenance; (b) they are of bulky construction and occupy a large floor area and cubic space; and (c) they are incapable of forming pallets of various sizes and shapes.

SUMMARY OF THE INVENTION

Thus, it is an object of the invention to provide a pallet-forming apparatus which readily avoids the aforenoted shortcomings of the prior art.

It is a further object of the invention to provide a pallet-forming apparatus wherein the surface on which the pallet is formed is substantially unobstructed and readily accessible for manual manipulation of the various pallet components.

Further and additional objects will appear from the description, accompanying drawings, and appended claims.

In accordance with one embodiment of the invention an apparatus is provided for forming a pallet having a plurality of elongated runners arranged in spaced substantially parallel relation and subtending a plurality of deck boards arranged in spaced parallel relation and spanning the distance between the runners. The apparatus includes a broad surface on which the pallet is formed, and a vertically adjustable elongated bridge overlying in spaced relation a predetermined area of the surface. Mounted on the bridge are a plurality of power actuated fastener-driving units which are arranged in longitudinally spaced relation on the bridge. An adjustable stop means is mounted on the surface for movement between oprative and inoperative positions. When in an operative position, the stop means projects upwardly from the surface and is engaged by a runner when the latter is in vertical alignment with the fastener-driving units. An adjustable runner-retaining means is mounted on the surface and, when in one position of adjustment, coacts with the stop means when the latter is in an operative position, to effect retention of the runner against the stop means and in aligned relation with the fastener-driving units as the latter are moved into engagement with segments of deck boards overlying the runner and secure same thereto. Control means are provided which are operatively connected to the stop means and the runner-retaining means whereby adjustment of said stop and runner-retaining means is in a predetermined timed sequence.

DESCRIPTION

For a more complete understanding of the invention reference should be made to the drawings wherein.

In many manufacturing and storage facilities, there is a limited need for various sizes and types of pallets to accommodate a variety of products produced or stored in the facility. Because of the high cost, complexity, and size of pallet-forming equipment presently available on the market, the use of such equipment in many instances cannot be economically justified. Heretofore, an alternative to the purchase of such equipment has been to purchase pallets from a suitable outside source. Such an alternative, however, is unsatisfactory for numerous reasons, such as (a) the unavailability and remoteness of such a source; (b) the difficulty and cost of shipping such pallets from the source to the customer; (c) the labor and space required by the customer to handle and store such pallets; and (d) the increased fire hazards involved in storing the pallets within or adjacent to the facility.

Figure 1:
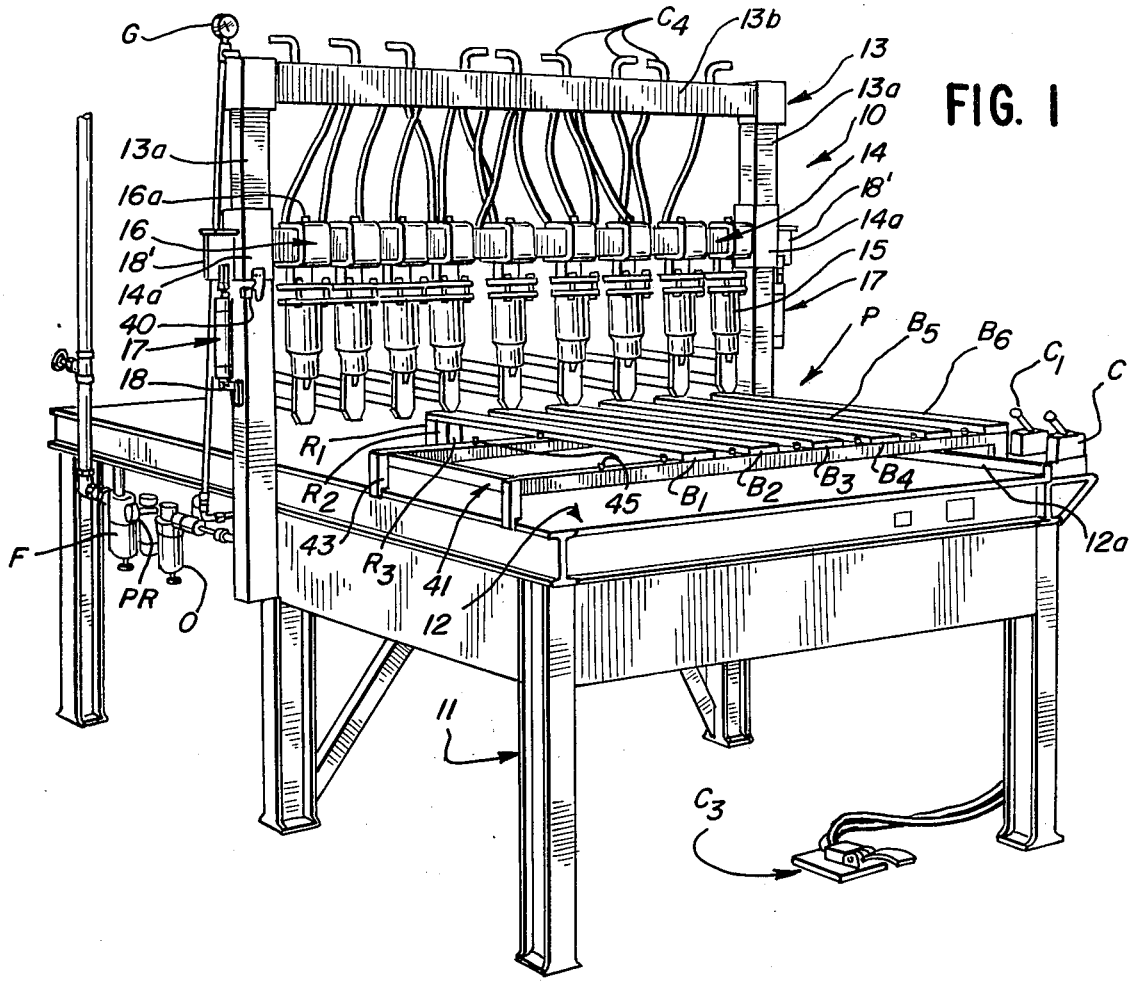
FIG. 1 is an enlarged fragmentary perspective view of one form of the improved apparatus and showing the pallet runners and deck boards in position on the supporting surface and the fastener-driving units disposed in an inoperative mode.

The improved apparatus 10 hereinafter described effectively overcomes the aforenoted problems associated with prior structures and alternative methods of producing or obtaining pallets. As seen in FIG. 1, one embodiment of the improved apparatus 10 is shown and includes a table-like frame 11 having a broad elevated substantially horizontal surface 12 on which the pallet P is to be formed. The apparatus will be described hereinafter with regards to a one-way pallet which embodies a plurality (e.g. three) of elongated runners $R_1$, $R_2$, $R_3$ which are arranged in uniformly spaced, substantially parallel relation. The runners are preferably of like configuration and are coextensive with one another. Secured to one side of and disposed in overlying relation with respect to the runners are a plurality of elongated deck boards $B_1$, $B_2$, $B_3$, $B_4$, $B_5$, and $B_6$. The number and length of the boards will depend upon the size and configuration of the pallet desired. The deck boards are preferably of like configuration and are arranged in spaced substantially parallel relation with boards $B_1$ and $B_6$ forming the end boards and normally aligned with the corresponding end portions of the subtending runners.

Disposed above the surface 12 and fixedly secured to opposite sides of frame 11 is an upright supporting structure 13. Structure 13 includes a pair of vertically extending stanchions 13*a* having the upper ends thereof interconnected by a cross member 13*b*. Disposed beneath the cross member and substantially parallel therewith is an elongated bridge 14. The bridge spans the distance between the stanchions and is slidably mounted thereon for controlled vertical adjustment. Carried on and depending from the bridge are a plurality of longitudinally spaced fastener-driving units 15. The number of units should at least equal the number of deck boards forming the pallet. The spacing between adjacent units conforms to the spacing between adjacent deck boards. Each of the units is connected to the bridge by a suitable bracket 16. A portion of the bracket embraces the bridge and is maintained in a selected horizontal position by a lock-bolt **16*a* or the like. Each unit is a conventional heavy duty industrial pneumatic staple gun (e.g., having an operating pressure of approximately 90 psig), which is mounted on the underside of bracket 16 by a plurality of suitable spring-loaded bolts 16*b*** and extends vertically downwardly therefrom.

Figure 5:
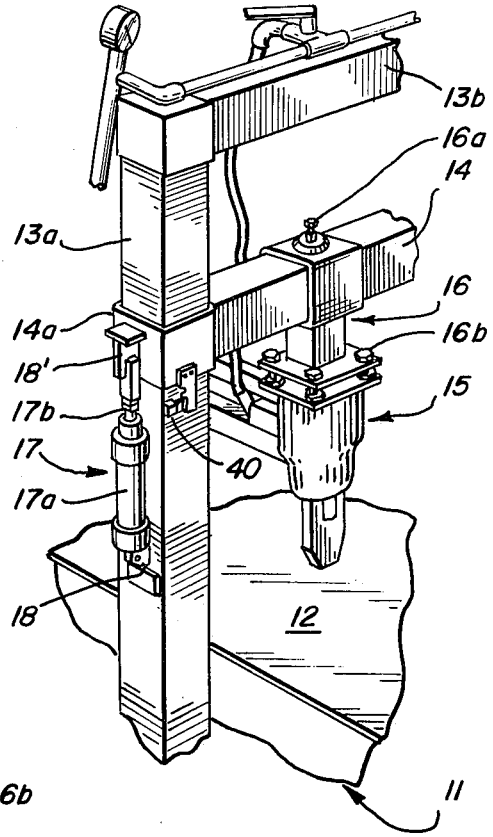
FIG. 5 is an enlarged fragmentary perspective view showing the means for effecting vertical adjustment of the bridge on which the fastener-driving units are mounted.

As seen in FIGS. 1, 5, the opposite ends of the bridge 14 are provided with sleeve attachments **14*a* which slidably embrace the adjacent stanchions 13*a*. Vertical adjustment of the attachments 14*a* relative to the stanchions is effected by a pair of pneumatically acutated piston-cylinder assemblies 17. Each assembly is of like configuration and, as seen in FIG. 5, includes a cylinder 17*a* connected at one end to an outwardly projecting lug 18 fixedly secured to the exterior of the stanchion. The exposed end of a piston rod 17*b* is connected to a second lug 18' which is fixedly secured to and projects from the bridge attachment 14*a*. Each cylinder 17*a* is provided with a suitable connector, not shown, for a common air line 19, see FIG. 9. A manually operated control valve C is mounted adjacent one side of the surface 12, see FIGS. 1 and 3. The piston 17*b* is normally biased upwardly whereby all of the bridge mounted units 15** assume a raised or inoperative position relative to the runners and deck boards arranged on the surface.

Figure 3:
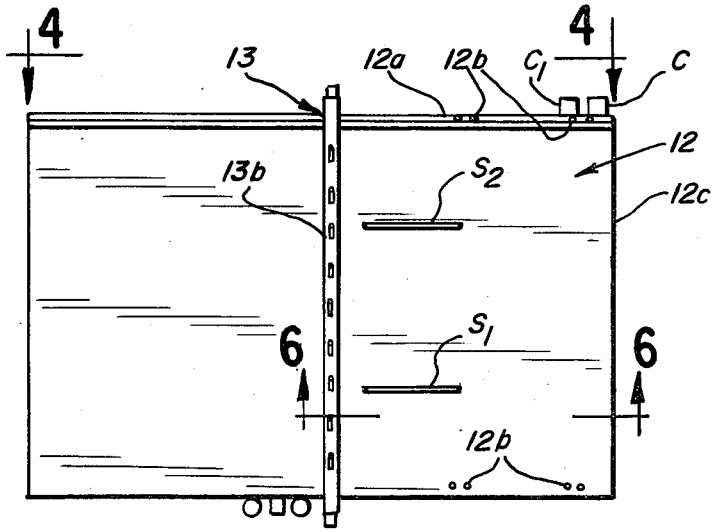
FIG. 3 is a fragmentary top plan view of the apparatus of FIG. 1 but with the runners, deck boards, and guide therefor removed.
Figure 4:
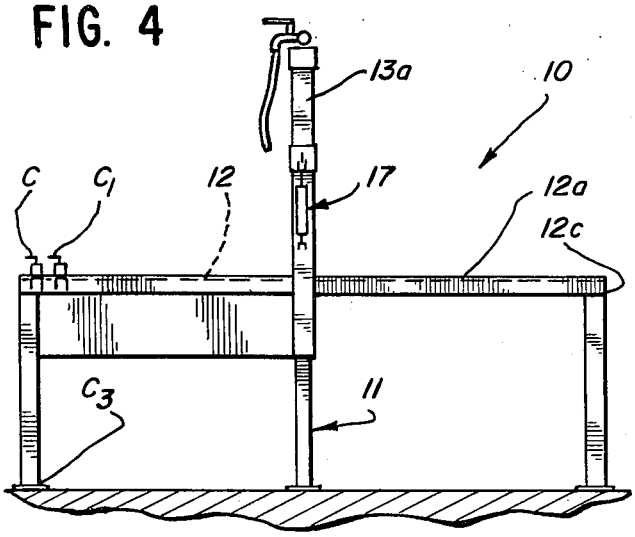
FIG. 4 is a fragmentary side elevational view taken along line 4—4 of FIG. 3.

Surface 12, as seen in FIG. 3, is provided with an elongated lip or flange **12*a* disposed along one side edge of the surface. The flange 12*a* extends upwardly from the surface edge and is disposed at substantially a right angle with respect to the elongated bridge 14 on which the fastener-driving units 15** are mounted.

Formed within surface 12 and disposed to one side of structure 13 is a pair of elongated slots $S_1$ and $_S2$. The slots are in spaced substantially parallel relation to each other and to flange **12*a*. The slots are substantially coextensive with each other and are spaced inwardly from the side edges of surface 12. Disposed beneath the slots and supported by the frame 11 is a runner-retaining assembly 20, see FIG. 6**.

Figure 6:
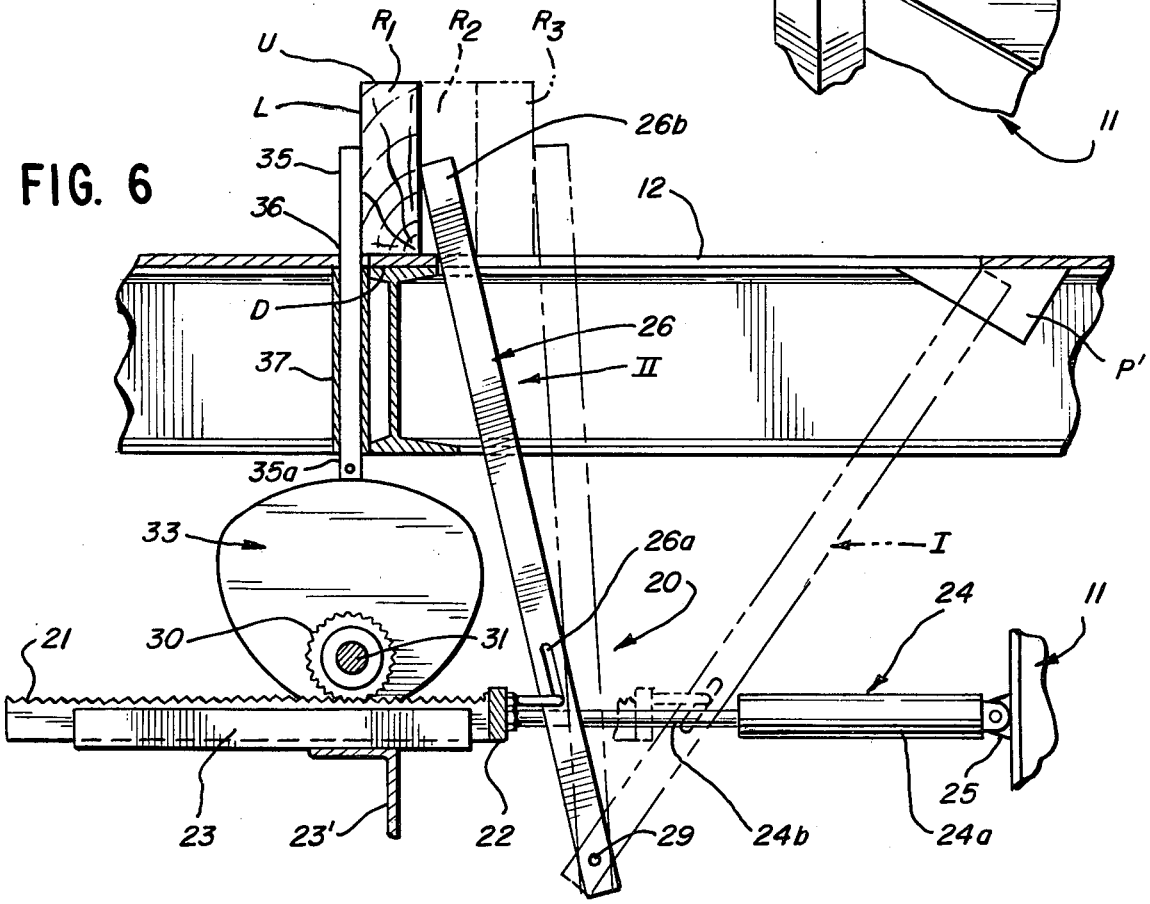
FIG. 6 is an enlarged fragmentary sectional view taken along line 6—6 of FIG. 3 and showing one of a plurality of runners being retained against the stop means by an arm of the runner-retaining means; the arm in various positions of adjustment and other runners are shown in phantom lines.
Figure 7:
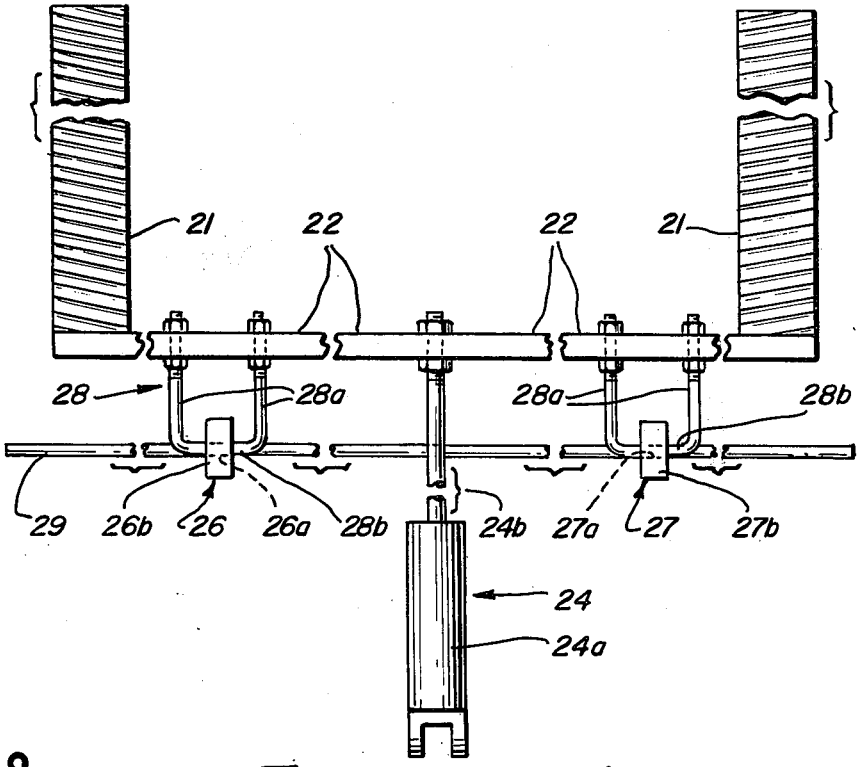
FIG. 7 is an enlarged fragmentary top plan view of the mechanism for effecting movement of the stop means and the runner-retaining means in a predetermined timed sequence.

In the illustrated embodiment, assembly 20 includes a pair of elongated racks 21, see FIG. 7, which are interconnected at one end by a cross piece 22. Each rack is slidably mounted within an elongated channel-like guide 23. Each guide is secured to a subtending support 23' which, in turn, is affixed to frame 11. Forward and rearward movement of the racks 21 is effected by a pneumatically-actuated piston-cylinder assembly 24. The assembly 24 may be similar to the piston-cylinder assemblies 17 and includes a cylinder **24*a* having the end thereof furthest removed from cross piece 22 connected to a suitable fixed lug 25 carried on the frame 11. A piston rod 24*b* projects from the opposite end of the cylinder and is connected by suitable means to cross piece 22 at substantially its mid-point. The cylinder 24*a* may house a bias spring, not shown, which would normally cause the piston rod 24*b* to assume a retracted position, shown in phantom lines in FIG. 6**.

Connected to cross piece 22 and disposed to the side thereof opposite the side from which the racks 21 extend is a pair of elongated arms 26, 27. Each arm is pivotally connected to an elongated rod 29 which is positioned below the plane of movement of the racks. The ends of rod 29 are suitably supported by frame 11. The connection between the cross piece 22 and the arms 26, 27 is effected by a pair of C-shaped elements 28, see FIG. 7. The legs **28*a* of each element are affixed at their ends to the cross piece 22 by suitable fastening means. The bail section 28*b* of each element extends through an elongated longitudinally extending slot 26*a*, 27*a*** formed in the arm.

The arms 26, 27 are vertically aligned with surface slots $S_1$, $S_2$, respectively. The length of each arm is such that when the piston rod **24*b* is in a retracted position with respect to the cylinder 24*a*, the upper free end 26*b*, 27*b* of the arm is recessed from surface 12 and is disposed within a suitable pocket P' provided on the underside of said surface. When the arm end 26*b*, 27*b* is disposed within the respective pocket, the arm is in an inoperative mode I, shown in phantom lines in FIG. 6. Because of the bias imposed on the piston rod 24*b* of the piston-cylinder assembly 24, the arms 26, 27 normally assume the inoperative mode. When the piston rod 24*b* is actuated to a fully extended position, shown in full lines in FIG. 6, the arms 26, 27 are pivoted in a counterclockwise direction to an operative mode II wherein the upper ends 26*b*, 27*b* project upwardly through the respective slots $S_1$, $S_2$ and engage either a bundle of runners or a single runner disposed beneath the bridge 14** in a manner to be described more fully hereinafter.

Figure 8:
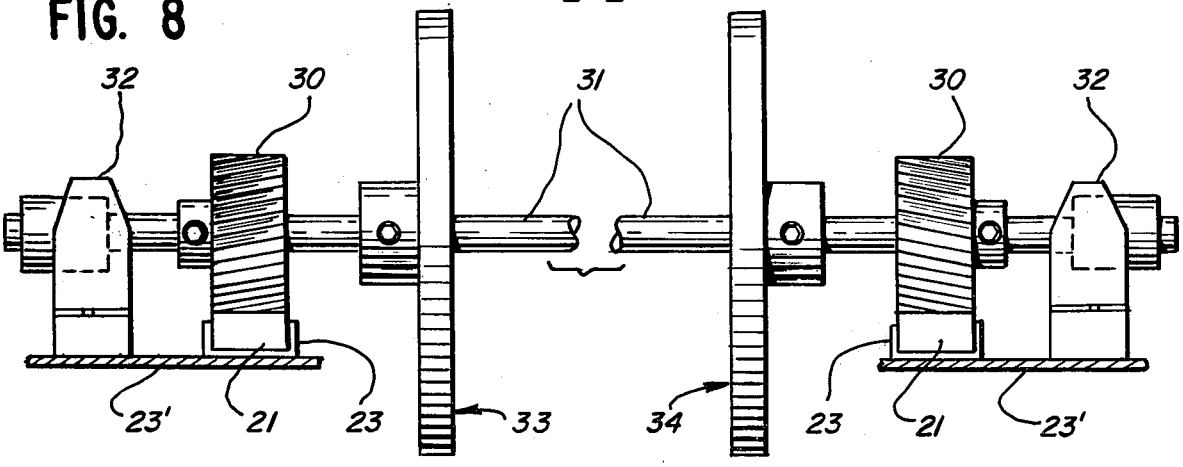
FIG. 8 is an enlarged fragmentary end view of the mechanism of FIG. 7.

As seen more clearly in FIGS. 6, 8, each rack 21 is in meshing engagement with a pinon gear 30. Each gear is keyed or otherwise secured to a transversely-extending shaft 31 which is supported beneath surface 12 by a pair of bearings 32 affixed to the frame support 23'. Also keyed to shaft 31 are a plurality of cam discs 33, 34. Each disc has a periphery of like configuration and the periphery in each instance is slidably engaged by the lower end **35*a* of a corresponding vertically extending stop pin 35. Each pin slidably extends through a suitable hole 36 formed in surface 12. A depending cylindrical sleeve 37 is fixedly positioned in each hole 36 and encompasses a portion of the pin and guides the vertical movement of the accommodated stop pin 35 as the cam disc 33, 34 is rotated. Rotation of the cam discs is effected by linear movement of the racks 21 which is translated into rotational movement by the meshing pinon gears 30**.

The stop pins 35 are aligned in spaced relation and form a row which, in turn, is substantially parallel to bridge 14 but slightly offset with respect thereto. When the stop pins are actuated by the cam discs into upwardly projecting (operative) positions with respect to surface 12, they are simultaneously engaged by a side surface L of the runner $R_1$ thereby properly positioning the upper surface U of runner $R_1$ beneath the fastener-driving units 15 carried on bridge 14. The runner $R_1$ or the bundle of runners, whichever the case may be, is retained against the raised stop pins 35 by the arm upper ends **26*b*, 27*b* when the latter assume their operative mode II. The movement of the arm upper ends to their operative mode II is coordinated with the upward positioning of the stop pins so that the latter are in such upward position prior to the arm upper ends contacting the runner even though the movement in each instance is derived from a single source, namely, from the piston-cylinder assembly 24. The sequential movement of the stop pins and arms is effected by the peripheral configuration of the cam discs 33, 34**.

The air input to cylinder 24*a* is controlled by a manually-actuated valve $C_1$, which is mounted adjacent one side of surface 12, preferably in the vicinity of the control valve C for the bridge height adjusting cylinders 17, previously described.

A third manual on-off valve $C_2$ is provided in the air supply line 38, the latter providing the charging pressure for each unit 15. Valve $C_2$ is adjusted to a closed position when one or more units are being replaced or repaired.

A fourth manual control valve $C_3$ is also provided which is preferably foot-operated and simultaneously controls the trigger mechanism for each fastener-driving unit. Individual shut-off valves $C_4$, one for each unit 15, may be provided so that the trigger mechanisms for selected units 15 can be rendered inoperative when desired, see FIG. 9.

Figure 9:
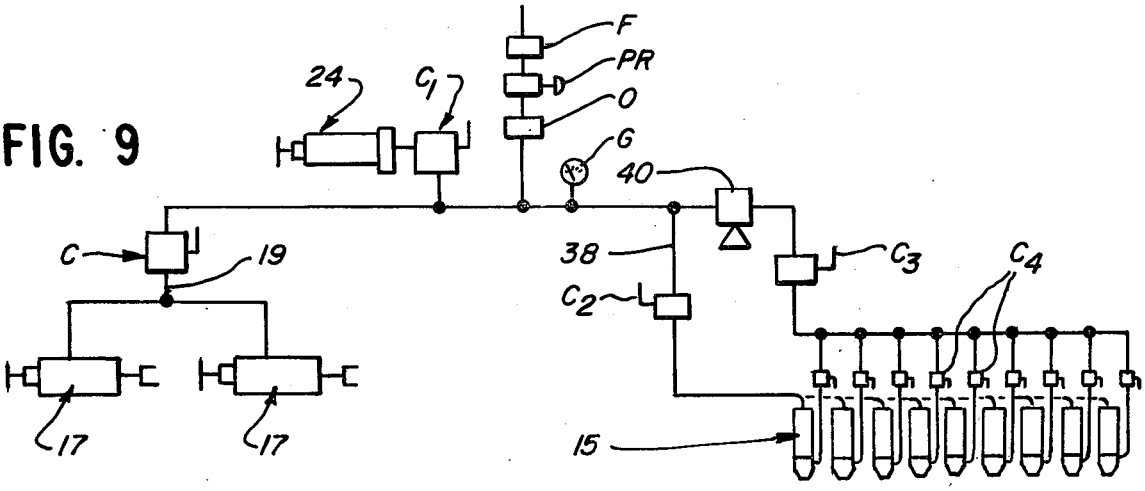
FIG. 9 is a schematic view of a pneumatic system for the apparatus of FIG. 1.

Besides the various valves aforementioned, the pneumatic circuit, shown in FIG. 9, would normally include a safety interlock 40 disposed in the high pressure line 41 leading from line 38 to valve $C_3$. Disposed upstream from valve $C_2$ and interlock 40 is a conventional pressure gauge G. Upstream of gauge G may be provided a conventional oiler O, a pressure regulator PR and a filter F. The filter is connected to the common source of air pressure normally maintained in the plant or facility wherein the apparatus is located.

Figure 2:
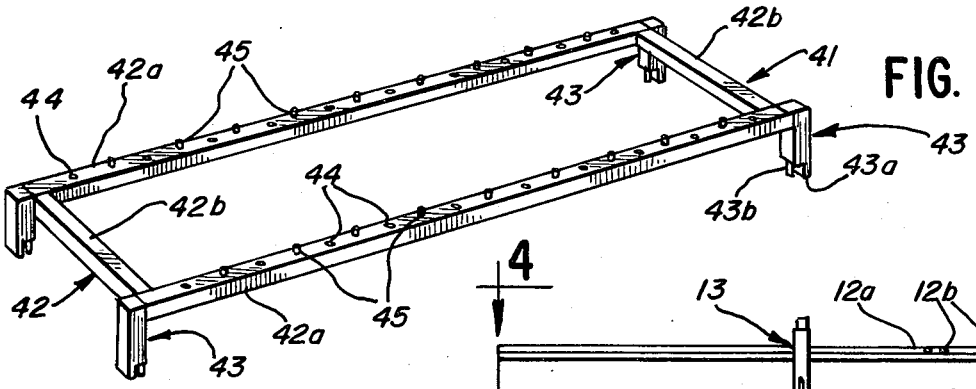
FIG. 2 is a perspective view of a deck board guide per se shown in FIG. 1.

FIG. 2 discloses a guide or jig 41 which is adapted to be removably mounted on surface 12. The jig is provided to facilitate positioning of the deck boards $B_1$–$B_6$ in proper relation to each other and to the runners, as will be described more fully hereinafter. The jig 41 embodies a skeletal member having a rectangular top section 42 and corner posts 43 depending therefrom. The lower ends 43*a* of the posts are shaped so as to engage edge portions of surface 12 and are provided with depending pins or dowels 43*b* which engage suitable holes 12*b* formed along peripheral edges of surface 12 and thereby maintain the top section 42 in a predetermined spaced, parallel relation with respect to surface 12. The elevation of the top section 42 relative to surface 12 corresponds substantially to the height of the runner upper surface U when the runner is resting upon surface 12 and is positioned beneath the fastener-driving units 15.

The top section 42 is formed of a pair of elongated side members 42*a* and a pair of end members 42*b*. Each side member is provided with a plurality of spaced openings 44 in which guide pins 45 are either fixedly or removably inserted and project upwardly therefrom. The number of guide pins and the relative spacing between adjoining pins will depend upon the number and arrangement of the deck boards forming the pallet P.

In utilizing the apparatus 10, the operator initially places a bundle of runners $R_1$, $R_2$, and $R_3$ (normally three in number and arranged in side-by-side substantially coextensive relation) on surface 12 with the corresponding runner ends abutting flange 12*a* and the runners extending transversely therefrom. When positioning the bundle on the surface, the operator places runner $R_1$ nearest the surface holes 36 and runner $R_3$ crossing approximately the central portions of slots $S_1$, $S_2$. While the bundle is being positioned on surface 12, the bridge 14 assumes its normal raised position wherein the fastener-driving units 15 are disposed in non-obstructing positions. Once the bundle of runners has been placed on surface 12 as indicated, the operator manipulates valve $C_1$ whereupon the stop pins 35 move upwardly from holes 36 and substantially simultaneously therewith arms 26, 27 pivot upwardly through slot $S_1$, $S_2$ and cause the bundle to be firmly held in place between the stop pins and arms and with runner $R_1$ properly aligned beneath units 15.

As an alternative procedure, the operator prior to placing the bundle of runners on surface 12 may manipulate the valve $C_1$ to a first position so that only the stop pins 35 project upwardly through the holes 36 while the arms 26, 27 remain at rest. Such movement of only the stop pins might be possible by adjusting the cam discs 33, 34 relative to the shaft 31 or by modifying the peripheral configuration of the cam discs. Once the stop pins are raised, the operator places the bundle on the surface 12 with the corresponding runner ends abutting flange 12*a* and with the exposed side of runner $R_1$ engaging the raised stop pins. The operator then manipulates valve $C_1$ to a second position whereupon the arms 26, 27 will pivot upwardly through slots $S_1$, $S_2$ and engage the exposed side of runner $R_3$ and retain the bundle in proper position between the stop pins and arms.

The jig 41 may or may not be in place when the bundle is being initially positioned on the surface 12 by the operator. It will be noted that the jig 41 is positioned rearwardly a substantial distance from the plane of movement of the fastener-driving units 15. Once jig 41 is in place on surface 12 and the bundle of runners held in proper position by the stop pins and arms, the operator positions the required number of deck boards $B_1$–$B_6$ on the jig top section 42 between the guide pins 45 so that the trailing or back ends of the boards are flush with the side of the top section side member 42*a* which is disposed closest to peripheral segment 12*c* of surface 12. When the board rear ends are so positioned, the corresponding front ends of the boards are properly aligned with the top surface of runner $R_1$. In positioning the deck boards on the jig, a corresponding side of each board is in contact with an aligned pair of guide pins 45. The end guide pins are arranged so that the outwardly facing side surfaces of the end boards $B_1$ and $B_6$ are in coplanar relation with the corresponding ends of the runners.

When the leading ends of the deck boards are properly positioned over the top surface U of runner $R_1$, the operator manipulates valve C thereby causing bridge 14 to move downwardly until the lower ends of units 15 engage the exposed surfaces of the portions of the deck boards overlying the top surface U of runner $R_1$. Once the ends of the units are engaging the exposed surface of the deck boards, the foot pedal of valve $C_3$ is depressed thereby triggering the units and causing fasteners (e.g., staples, nails) to be driven therefrom through the boards and into the underlying runner $R_1$. After the boards have been secured to runner $R_1$, the operator manipulates valve C allowing the bridge 14 to return to its initial raised position, and also manipulates valve $C_1$ causing the stop pins 35 and the arms 26, 27 to assume retracted or inoperative positions. Once this occurs, the boards and attached runner $R_1$ are manually moved forward such that the trailing ends of the deck boards are positioned over the jig side member 42*a* which is closest to the units 15. The procedure previously described regarding raising of the stop pins 35 and arm upper ends 26*b*, 27*b*; lowering of the bridge 14; and triggering the units is repeated for both of the remaining runners $R_2$, $R_3$.

After the trailing ends of the deck boards have been secured to runner $R_3$, the jig 41 is removed and the formed pallet P may be turned upside down so that the deck boards rest upon surface 12. While the pallet is in such inverted position, additional boards can be secured to the upwardly facing surfaces D of the runners in a manner as previously described.

While the various piston-cylinder assemblies and fastener-driving units have been described as being pneumatically actuated, it is to be understood that the invention is not intended to be limited thereto as electromechanical or hydraulically actuated components may be substituted thereof.

Thus, it will be seen that a simple, inexpensive, compact apparatus has been provided which can be readily operated and only requires a minimal amount of manual effort. The apparatus is readily capable of accommodating pallets of varying size and configuration.

I claim:

1. An apparatus for forming a pallet having a plurality of elongated runners arranged in spaced substantially parallel relation and subtending a plurality of elongated deck boards arranged in spaced substantially parallel relation and extending transversely of the runners and spanning the distance therebetween; said apparatus comprising a substantially horizontal surface for supporting thereon a plurality of the runners with the deck boards overlying the latter; an elongated support member disposed in spaced overlying relation with respect to a predetermined elongated area of said surface; a plurality of power actuated fastener-driving means mounted on and depending from said support member, said driving means being arranged in spaced side-by-side relation and forming an elongated row, said row being in spaced, overlying substantially parallel relation with the predetermined elongated area of said surface and with a runner when the latter is disposed at said predetermined surface area, said plurality of driving means and at least a portion of said support member being selectively movable as a unit relative to said surface between operative and inoperative modes, when in an operative mode, said plurality of driving means being adapted to engage and secure corresponding segments of the deck boards to a subtending runner disposed at said predetermined surface area, when in an inoperative mode, said plurality of driving means being elevated and out of contact with the runner supported deck boards; adjustable stop means disposed adjacent said predetermined surface area and mounted for selective movement relative to said surface between projected and retracted positions, when in a projected position, said stop means being engaged by a runner disposed at said predetermined surface area and preventing further movement of the runner in one direction along the surface, and when in a retracted position, said stop means being out of engagement with the runner disposed at said predetermined surface area; adjustably mounted runner-retaining means coacting with said stop means when in a projected position, to effect retention of a runner against said stop means, when said driving means is in said operative mode; and means coacting with said stop means and said runner-retaining means for effecting relative movement thereof in a predetermined time sequence.

2. The apparatus of claim 1 wherein the runner-retaining means includes at least one elongated pivotally mounted arm; when in one position of pivotal adjustment, said arm having a distal portion disposed above said surface and extending towards the projected stop means and urging a runner into engagement with said projected stop means.

3. The apparatus of claim 1 wherein said stop means includes at least one cam movably mounted beneath the surface, and an elongated upright element slidably mounted within an opening formed in said surface adjacent the predetermined area thereof, one end of said element being in sliding contact with the periphery of said cam; the opposite end portion of said element protruding from said surface only when said stop means is in a projected position for engagement by a runner when the latter is disposed at the predetermined area of said supporting surface.

4. The apparatus of claim 3 wherein said cam is rotatably mounted and rotation thereof is effected by an elongated member disposed beneath said surface and mounted for controlled endwise movement, and a rotary means mounted for unitary rotary movement with said cam, said rotary means being adjacent the path of travel of said elongated member and in driving contact therewith.

5. The apparatus of claim 4 wherein the elongated member is operatively connected to a pivotally mounted elongated arm forming a component of the runner-retaining means, said arm being responsive to the movement of the elongated member in one direction and moving to an operative position urging a runner against said stop means while the latter is in said projected position.

6. The apparatus of claim 1 wherein the runner-supporting surface is provided with a deck board guide means for supporting the plurality of deck boards in a predetermined arrangement above said surface.

* * * * *